US006058908A

United States Patent [19]

Masters

[11] Patent Number: 6,058,908

[45] Date of Patent: May 9, 2000

[54] HALL EFFECT IGNITION

[75] Inventor: Stephen C. Masters, El Paso, Tex.

[73] Assignee: Autotronic Controls Corporation, El Paso, Tex.

[21] Appl. No.: 09/087,750

[22] Filed: May 29, 1998

[51] Int. Cl.[7] ..... F02P 5/145; F02P 17/02

[52] U.S. Cl. ..... 123/406.59; 123/617; 324/381

[58] Field of Search ..... 123/406.59, 406.58, 123/617; 324/381, 391, 392

[56] References Cited

U.S. PATENT DOCUMENTS

| | | | |
|---|---|---|---|
| 3,139,876 | 7/1964 | Jukes | 123/618 |
| 3,874,351 | 4/1975 | Adler et al. | 123/610 |
| 3,923,030 | 12/1975 | Luteran | 123/406.58 |
| 3,997,801 | 12/1976 | Caron et al. | 123/406.58 |
| 4,102,311 | 7/1978 | Crall et al. | 123/406.66 |
| 4,104,998 | 8/1978 | Fenn | 123/406.52 |
| 4,131,098 | 12/1978 | Daniels et al. | 123/406.59 |
| 4,156,411 | 5/1979 | Crall et al. | 123/406.58 |
| 4,226,219 | 10/1980 | Olmstead | 123/406.53 |
| 4,275,703 | 6/1981 | Bodig et al. | 123/617 |
| 5,513,617 | 5/1996 | Bass | 123/595 |
| 5,757,179 | 5/1998 | McCurley et al. | 324/207.2 |

*Primary Examiner*—Tony M. Argenbright
*Assistant Examiner*—Arnold Castro
*Attorney, Agent, or Firm*—Fitch, Even, Tabin & Flannery

[57] ABSTRACT

An electronic ignition system according to an embodiment of the present invention includes a Hall effect device for detecting crankshaft rotation. A circuit is provided to select first or second ignition timing responsive to the Hall effect device output based on the rate of crankshaft rotation.

19 Claims, 10 Drawing Sheets

| |
|---|
| Fig.2A |
| Fig.2B |
| Fig.2C |
| Fig.2D |

| |
|---|
| Fig.2A |
| Fig.2B |
| Fig.2C |
| Fig.2D |

| |
|---|
| Fig.2A |
| Fig.2B |
| Fig.2C |
| Fig.2D |

| |
|---|
| Fig.2A |
| Fig.2B |
| Fig.2C |
| Fig.2D |

| |
|---|
| Fig.3A |
| Fig.3B |
| Fig.3C |
| Fig.3D |

| |
|---|
| Fig.3A |
| Fig.3B |
| Fig.3C |
| Fig.3D |

| |
|---|
| Fig.3A |
| Fig.3B |
| Fig.3C |
| Fig.3D |

| |
|---|
| Fig.3A |
| Fig.3B |
| Fig.3C |
| Fig.3D |

509
500
40°
502
112a

S
N

504
N
S
112a

HALL EFFECT IGNITION

BACKGROUND OF THE INVENTION

1. Field of the Invention

The present invention relates to ignition systems, and in particular to an improved ignition system for variable ignition timing.

2. Description of the Related Art

Sophisticated, high-priced engines in vehicular or stationary application generally use the principle of variable ignition timing. Variable ignition timing provides the easiest possible starting for the engine (retarded timing) and the most efficient high-speed engine operation (advanced timing). On most vehicles, for many years, the timing adjustment was handled by a distributor which used either centrifugal weights or the engine vacuum to vary the timing. In recent years, many vehicle and stationary engines have used computerized distributor-less ignitions. Such distributor-less ignitions use inputs from engine speed and load sensors to electronically vary the timing of ignition coil firing.

Single cylinder engines cannot use a distributor and have, for economic reasons, not been known to be equipped with computer-controlled ignitions except in laboratory settings. Instead, these engines are equipped with either magneto or inductive ignitions which use a fixed ignition timing set somewhere between ideal startup timing and ideal running timing. Additionally, the same economics have dictated that the ignitions used be comparatively low power with limited spark energy. Moderately hard starting, occasional misfires and less than optimum engine efficiency have had to be tolerated as reflecting the best technology reasonably available. These shortcomings have been particularly apparent in engines run on gaseous fuels. The far higher voltage demand of gaseous fuels have rendered gaseous fuel unusable in some engines.

Accordingly, there is a need for a small engine ignition system with a high-energy spark as well as multi-sparking. There is a still further need for a small engine ignition system which provides for complete ignition of the air fuel mixture and resulting in both the absence of misfires and greatly improved engine efficiency.

SUMMARY OF THE INVENTION

An electronic ignition system according to an embodiment of the present invention includes a linear output Hall effect device for detecting crankshaft rotation. A circuit is provided to select first or second ignition timing responsive to the Hall effect device output based on the rate or position of crankshaft rotation.

According to one embodiment, a comparator receives as one input a signal from the linear output Hall effect device. A level of the second input is automatically selectable to alter the comparator threshold based on crankshaft rotation. The comparator output is provided to a multi-spark circuit to control sparking based on the voltage level.

BRIEF DESCRIPTION OF THE DRAWINGS

A better understanding of the present invention is obtained when the following detailed description is considered in conjunction with the following drawings in which.

DETAILED DESCRIPTION OF THE INVENTION

Figure 1:
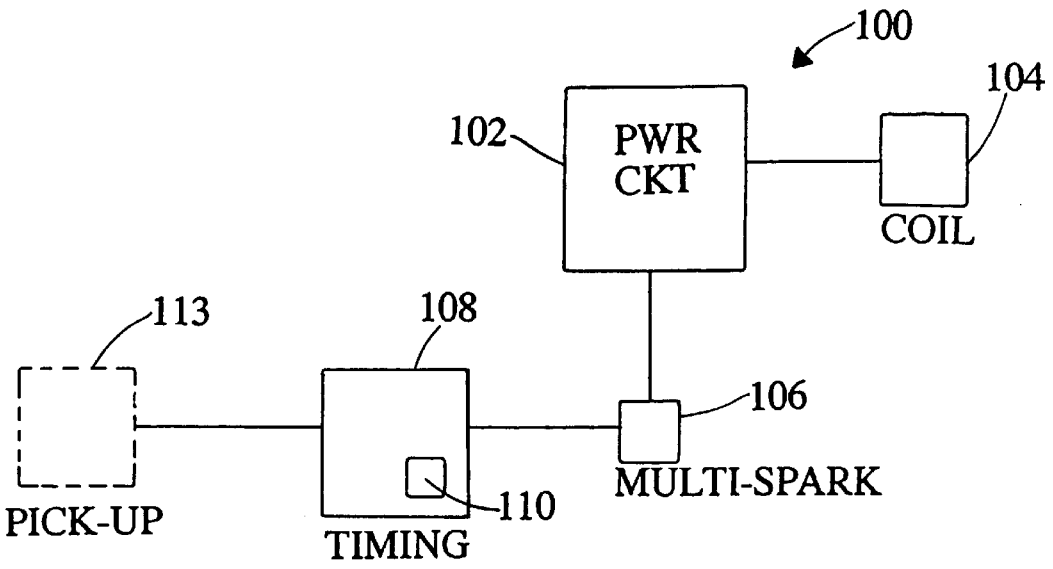
FIG. 1 is a block diagram of an electronic ignition system in accordance with the present invention.

Turning now to the drawings and with particular attention to FIG. 1, there is illustrated therein an electronic ignition system 100 according to an embodiment of the present invention. The electronic ignition system 100 according to the present invention may be used to considerable advantage on any single cylinder two-or four-stroke engine. Multiple units may be coupled together to be used on multi-cylinder engines. The electronic ignition system 100 according to the present invention is particularly advantageous for use on single-cylinder four-stroke engines run on gaseous fuels such as propane or methane.

The electronic ignition system 100 includes a magnetic flux responsive device 113 according to the present invention. A signal representative of crankshaft position may be generated by the magnetic flux responsive device, such as a linear output Hall effect magnetic pickup 113, which is then processed into a signal representing engine rotation and connected to a timing circuit 108. As will be described in greater detail below, according to the present invention, the magnetic flux responsive device 113 is described and illustrated as a Hall effect sensor. However, it should be understood that other magnetic flux responsive devices are also within the broad scope of the invention, such as, magneto-resistive elements (MRE), magneto-resistive sensors (MRS), Reed switches, and the like.

The power circuit 102 generates an A/C signal of sufficient power to produce ignition spark. In particular, the power circuit 102 converts the signal to a high energy spark producing voltage for application to a spark gap (not shown) via an ignition coil 104.

As will be explained in greater detail below, the arrangement of the electronic ignition 100 also includes a timing circuit 108 which receives the signals from the linear output Hall effect magnetic pickup 113 and generates a signal for control of ignition timing. A timing select circuit 110 is provided responsive to the linear output Hall effect magnetic pickup 113 output to select first or second timings, depending on whether the engine is in "start" or "run" mode. The output of the timing circuit 108 is provided to a multi-spark circuit 106 which, in turn, is provided to the power circuit 102. The multi-spark circuit 106 provides a plurality of sparks responsive to the timing select circuit 110 output, as will be discussed in greater detail below.

Figures 2, 2A:
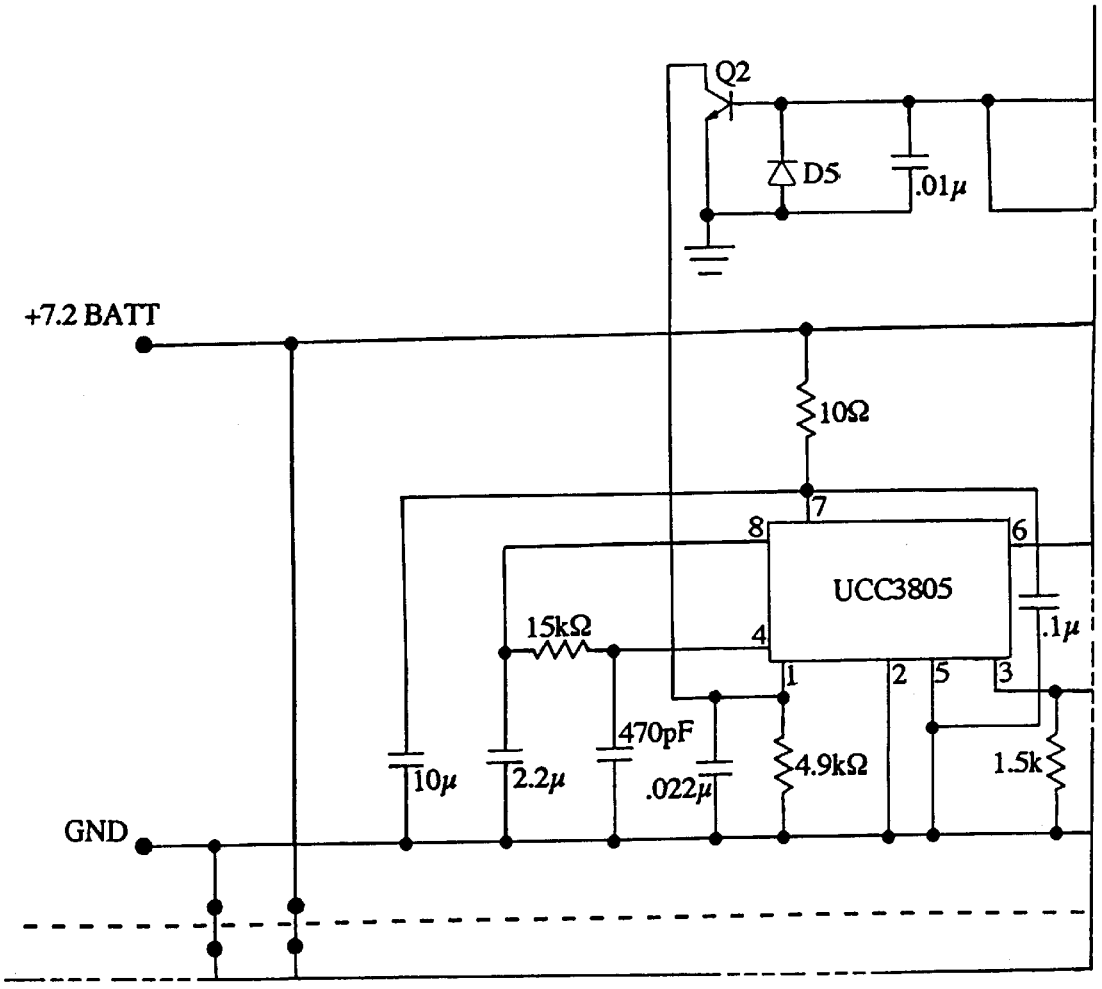
FIG. 2 is a schematic diagram illustrating ignition power and timing power circuitry according to an embodiment of the electronic ignition system of FIG. 1.
Figures 2, 2B:
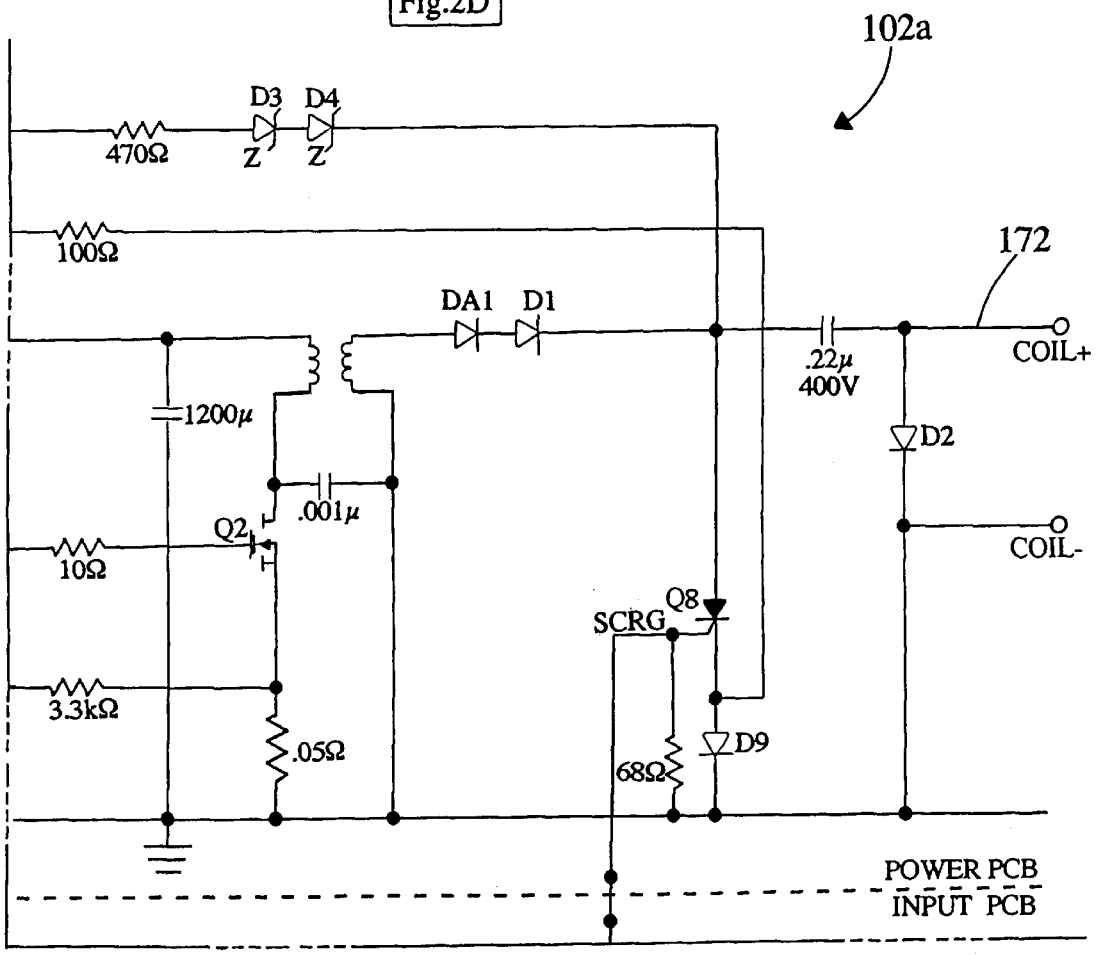
Figures 2, 2C:
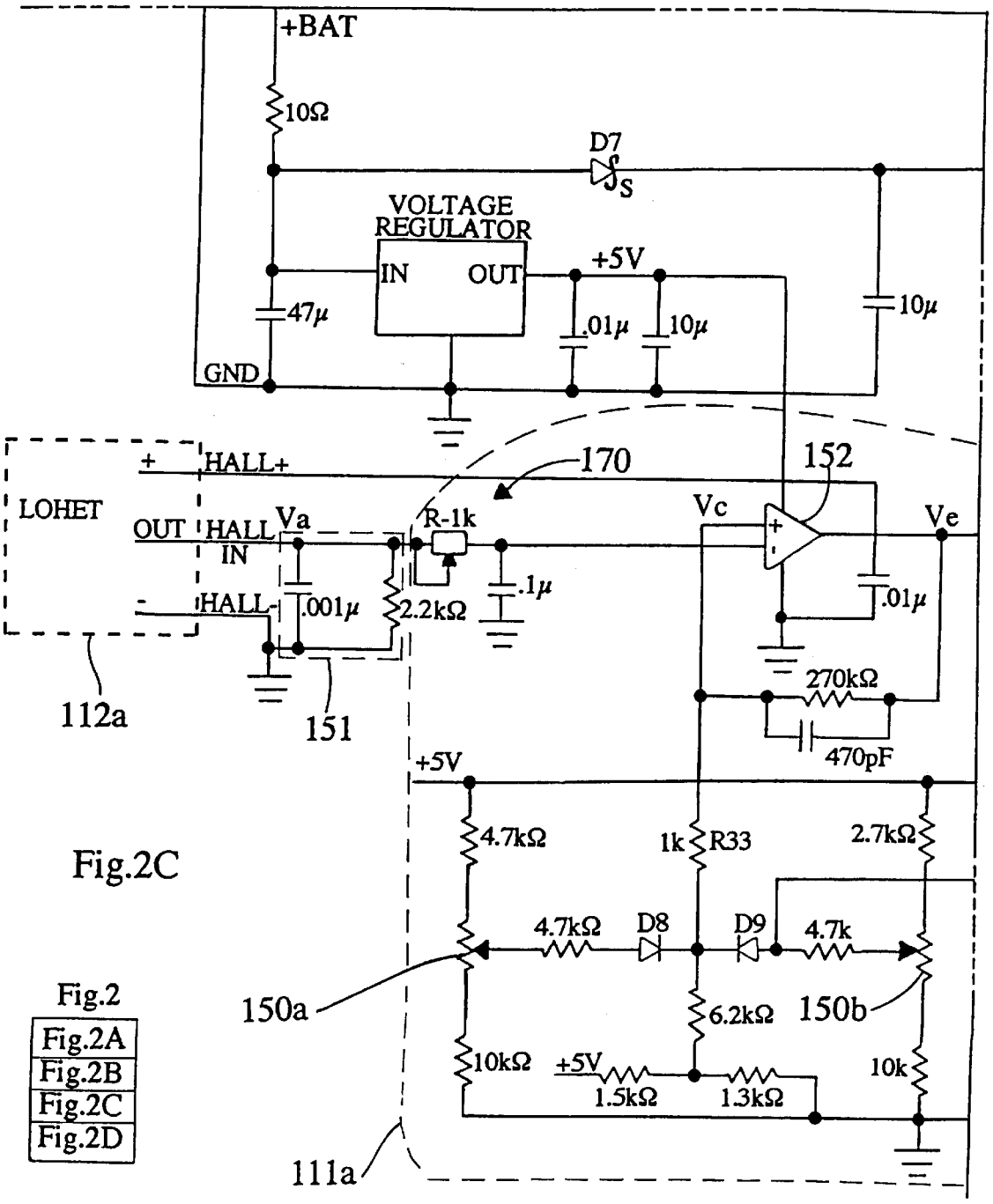
Figures 2, 2D:
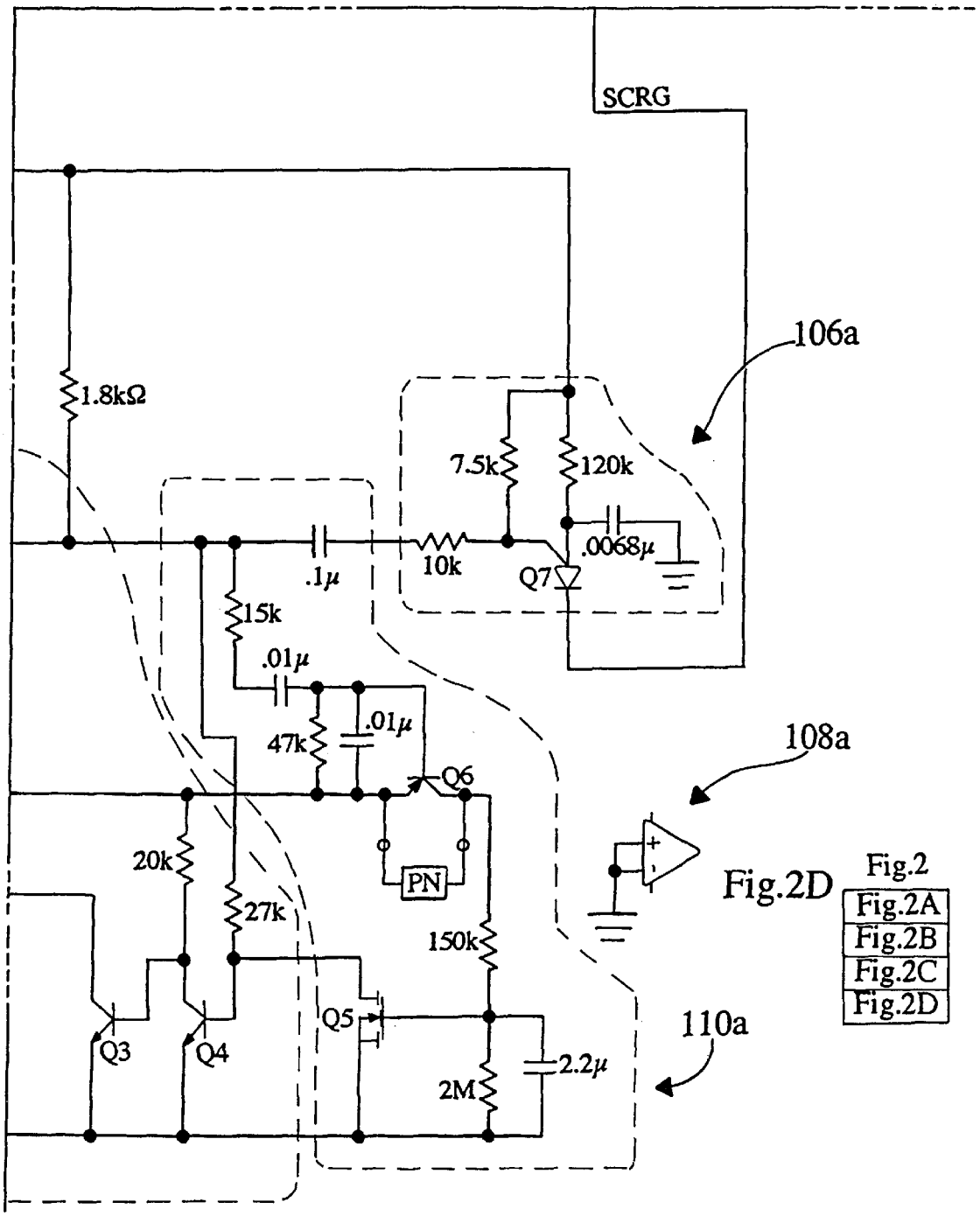

A first embodiment of a Hall effect ignition system 100*a* according to he present invention is illustrated in FIG. 2. The Hall effect ignition system 100*a* includes a power circuit 102*a,* a timing circuit 108*a,* a timing select circuit 110*a,* and a multi-spark circuit 106*a.* The timing circuit 108*a* further includes a run/start circuit 111. The Hall effect ignition 100*a* further includes a linear output Hall effect device (LOHET) 112*a* which provides as an output a nearly linear ramp voltage HALL IN which peaks just after or at the top dead center (TDC) piston/crankshaft position. The run/start circuit 111*a* includes two potentiometers 150*a,* 150*b* and automatically selects one of two adjustable voltages which represent "start" timing and "run" timing, respectively.

Figure 4:
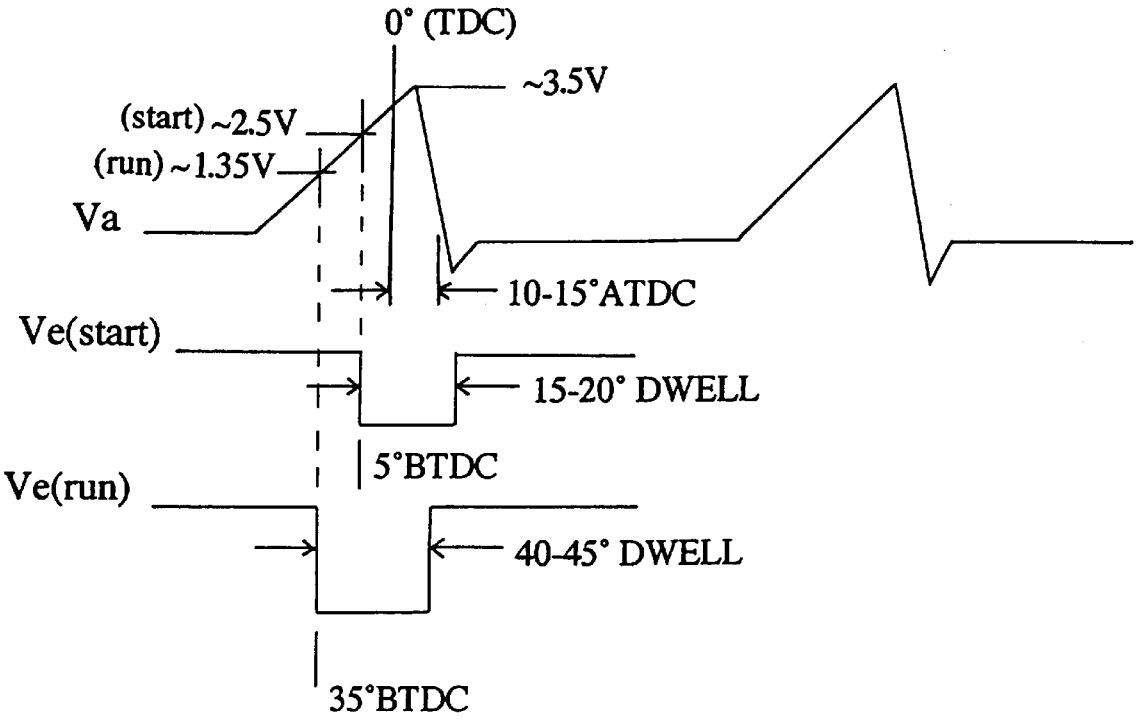
FIG. 4 is a diagram illustrating input voltage with respect to spark timing for use in an ignition according to an embodiment of the present invention.

As seen in FIG. 4, "start" timing may typically occur at or near TDC or about 5° before top dead center (BTDC), where a relatively higher voltage is used. By contrast, the second potentiometer 150*a* is used to select "run" timing, typically 28°–35° before top dead center (BTDC), when a relatively lower voltage level is used. The voltage level is selected automatically as a function of the setting of the potentiometers 150*a,* 150*b,* after the engine has run several seconds above idle speed, as will be described in greater detail below.

In particular, a signal HALL IN from the LOHET 112*a* is provided to a differentiator circuit 151, which includes a capacitor C17 and a resistor R11. The timing circuit 108*a* receives as input a signal Vin from the differentiator 151. The differentiator 151 provides an output representative of the rate of engine rotation, depending on the slope of $V_a$. As engine speed increases, the slope of $V_a$ increases, and the level of Vin increases. The other input $V_c$ to the comparator 152 is provided via the run/start circuit 111. The comparator 152 provides an output voltage $V_e$ at different times depending on whether the engine is in start up or high speed operation. The output voltage $V_e$ is used as input to the multi-spark circuit 106*a,* including a programmable unijunction transistor (PUT) Q7. The output of the PUT Q7 is provided to a silicon controlled rectifier (SCR) Q8 of the power circuit 102*a* to control charging and discharging of a storage capacitor C8. The PUT Q7 is gated via the $V_e$ output of the comparator 152 via the capacitor C14 which limits the multi-sparking period via $R_c$ of the network R12-R13-C14. This is set about 3–5 sparks at startup with a 15° to 20° dwell, and automatically decreases as engine speed increases until only a single spark occurs above about 6,000 rpm.

More particularly, the comparison threshold on the Vin voltage is selected to correspond to the TDC voltage at start up, and a substantially lower voltage (before TDC) during high speed "run" operation. The ADV (run) potentiometer 150*a* is used to select the threshold for "run" timing, and the TDC (start) potentiometer 150*b* is used to select the threshold for "start" timing. That is, the TDC potentiometer 150*b* is configured to provide a threshold of about 3–3.5 Volts, corresponding to below 800 rpm. The ADV potentiometer 150*a,* in contrast, provides a lower threshold above 800 rpm, as will be described below. Thus, the ADV potentiometer 150*a* is used to vary the threshold which will result in the $V_e$ (run) output (FIG. 4), and the TDC potentiometer 150*b* is used to vary the threshold which will result in the $V_e$ (start) output (FIG. 4).

When the engine starts up, $V_e$ is too low to activate the transistor Q6 of the timing select circuit 110. Instead, $V_e$, through the transistors Q4 and Q3, provides a positive voltage to the anode of the diode D9, causing the diode D9 to conduct. This voltage is provided as the voltage $V_c$ to the comparator 152 via a resistor R33. This causes the threshold voltage $V_c$ to be about 3 Volts or corresponding to near TDC. About 4–5 seconds after the engine begins rotating, the transistor Q6 is pulsed on, which closes C19, turning on the transistor Q5. When the transistor Q5 turns on, the transistor Q4 is biased off, which biases the transistor Q3 on, grounding the anode of the diode D9, the reference for the TDC potentiometer 150*b*. During this condition, the ADV potentiometer 150*a* provides the voltage reference threshold via D8 to the input of the comparator 152. The resistors R18-R19-R20 of the run/start circuit 111*a* provide the minimum bias voltage to the comparator 152, about 2.6V. The resistor R30 provides he hysteresis, about 50–100 mV. During the transition between timings, AC hysteresis is provided by the capacitor C18, to provide noise immunity. The ignition normally latches at this selection (run timing) unless the motor is capable of extremely low idle speed, i.e., below 800 rpm, in which case, start timing voltage will be selected. The voltage levels are also controlled with a large amount of hysteresis on the falling edge of the LOHET 112*a* input voltage ramp so as to insure a clear, wide pulse for the PUT (programmable uni-junction transistor) multi-spark circuit 106*a*.

Figure 5A:
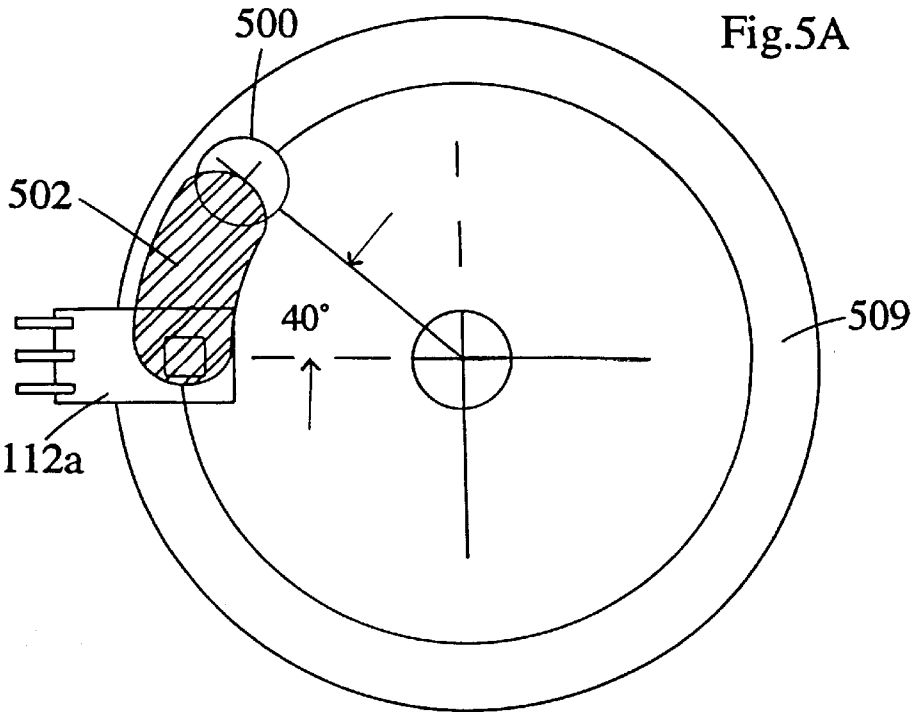
FIGS. 5A–5D are diagrams illustrating sensor configurations for use in electronic ignition systems according to the present invention.
Figure 5B:
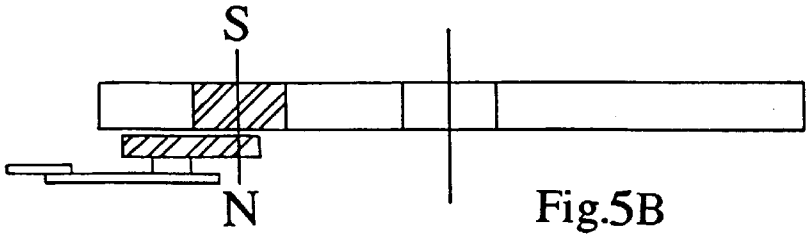
Figure 5C:
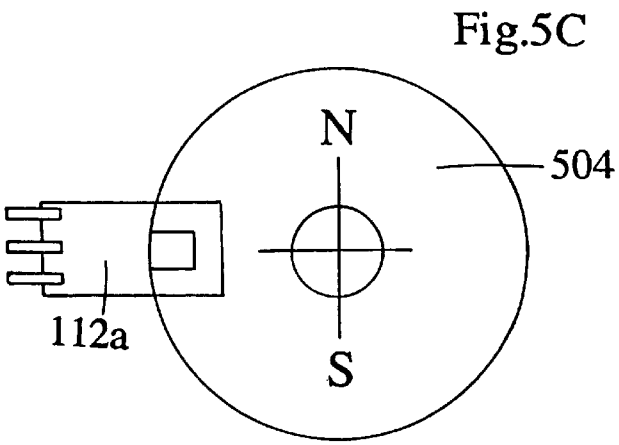
Figure 5D:
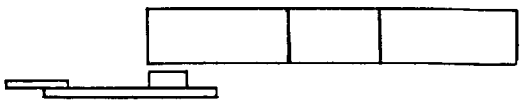

The magnetic circuit includes the LOHET 112*a,* a magnet 500 and may incorporate a flux concentrator 502 (FIGS. 5A and 5B). The magnet 500 may be a single pole 26 KiloGauss magnet, with flux lines perpendicular to the plane of rotation. The flux concentrator 502*a* is used to shape the output ramp voltage to a near linear ramp with a fast falling edge after top dead center, as shown in FIG. 4. The magnet 500 may be a ¼-inch diameter samarium cobalt (SMCO) magnet positioned at a bolt circle diameter (BC) over 1.5 inches. The magnet 500 and/or magnet and flux concentrator are configured to sweep an arc of about 40°–50° (i.e., the total ramp width may be about 40–50°). The magnet 500 is rigidly mounted relative to a rotating engine component 509, such as a crankshaft. Alternatively, the magnet 500 may be formed as a ring magnet as shown in FIGS. 5C and 5D, for example, a SMCO magnet configured to fit on the engine crankshaft with an output level of, for example, greater than about 2 kiloGauss. An exemplary two-pole diametrically magnetized magnet is illustrated. Other magnet configurations are considered to be within the broad scope of the invention, such as radially magnetized magnets and magnets having more than two poles. In configurations using a ring magnet, as shown in FIGS. 5C and 5D, a flux concentrator may not be required. The flux concentrator 502 may be generally arcuate in shape and may be formed from a soft magnetic material, for example 0.010–0.020 inch thick silicon steel. The flux concentrator 502 is positioned to precede the magnet 500 as the engine component 509 rotates towards the Hall effect device 112*a*. More particularly, the flux concentrator 502 is positioned in close proximity to the LOHET and arcs away from the LOHET so that the magnet passing by the first transfers flux lines before top dead center, for example, 45°. The flux continues to increase as more of the magnet overlaps the flux concentrator 502 and as the magnet 500 nears the LOHET. When the magnet 500 is centered over the LOHET, the flux is at maximum and the LOHET output is at maximum voltage. As the magnet swings past the LOHET 112*a* and flux concentrator 502*a*, the flux drops quickly over several degrees of rotation past TDC.

The top dead center (TDC) reference is about 20° to 25° before the positive voltage peak using a two-pole ring magnet and a LOHET. Hysteresis can be lengthened by adjusting the position of the magnet relative to the LOHET, since the voltage input swings below 2.5 volts, for improved noise immunity and pulse width widening. However, this can be detrimental to multi-spark duration if a less than 20° limiter is used to limit the multi-spark period to about 20° from the spark enable edge. In this case, the single unipolar ¼-inch magnet is advantageous in that the multi-spark period only lasts up to about 10° to 15° after top dead center.

Optional high-speed retard can be achieved by adding an RC circuit 170 between the LOHET output and the $V_c$ input. A 1K resistor and a 0.1 mf capacitor will give a slope of about 0.6° per 1000 rpm timing retard rate. If a potentiometer is used, as little as 0.1° to 0.6°/1000 rpm can be adjusted. Most two-stroke engines run cooler if the timing is retarded around 0.4° to 0.5° per 1000 rpm for high-speed operation (about 10K rpm).

The timing can be checked and adjusted without the engine running by closing the PUSH-NOW switch PN. This turns on the transistor Q5 in about ½ second and selects the run timing $V_e$ reference threshold voltage. The engine can then be rotated and spark generation noted at run timing. When the switch is released, the capacitor C19 discharges via the resistor R26 in about two seconds and the start timing can be checked and adjusted by rotating the engine until a spark is generated. The timing is normally adjusted by first setting the run timing, then setting the start timing, then readjusting the run timing to its final setting. The timing can be verified by a strobe light while the engine is running, although the start timing will be present for only a few seconds before run timing is selected.

Figures 3, 3A:
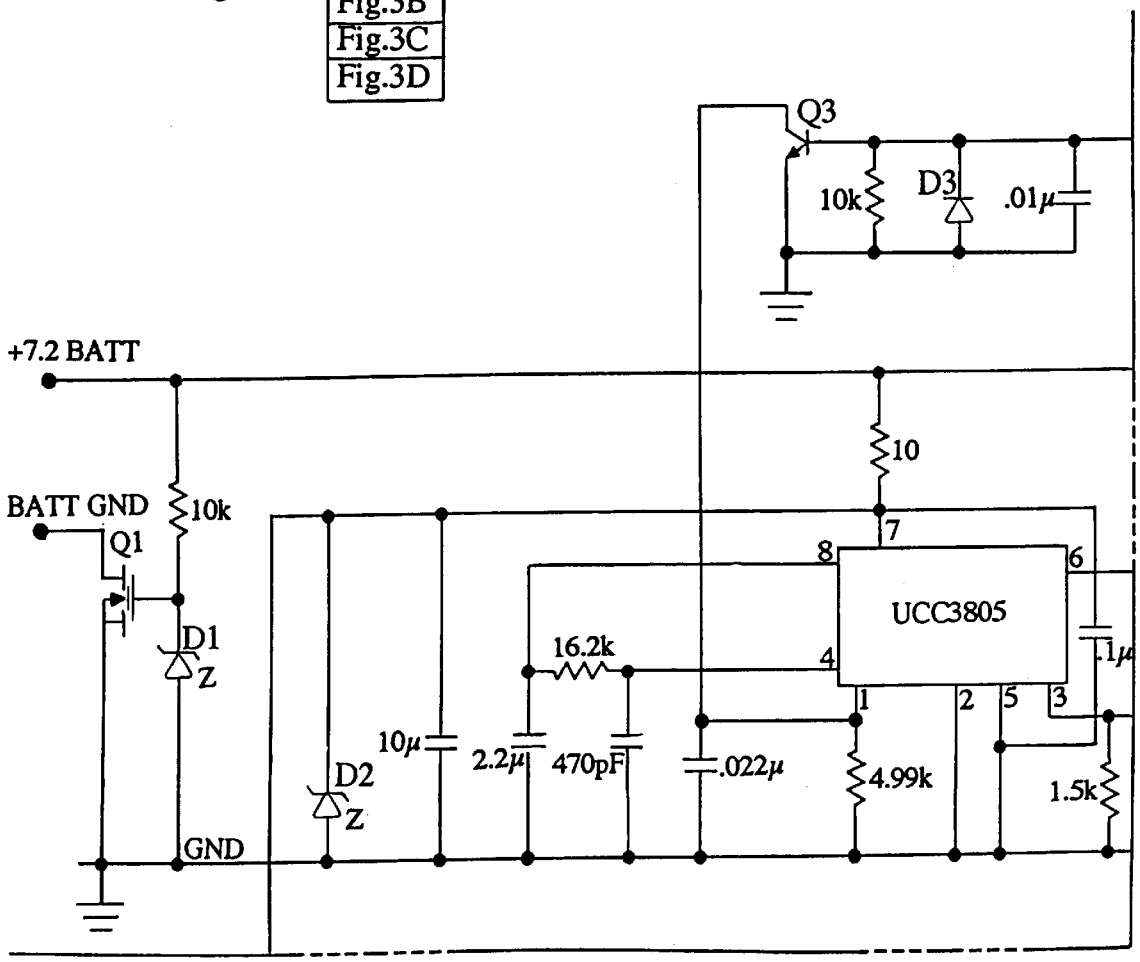
FIG. 3 is a schematic diagram illustrating the circuitry of an electronic ignition system according to an embodiment of the present invention.
Figures 3, 3B:
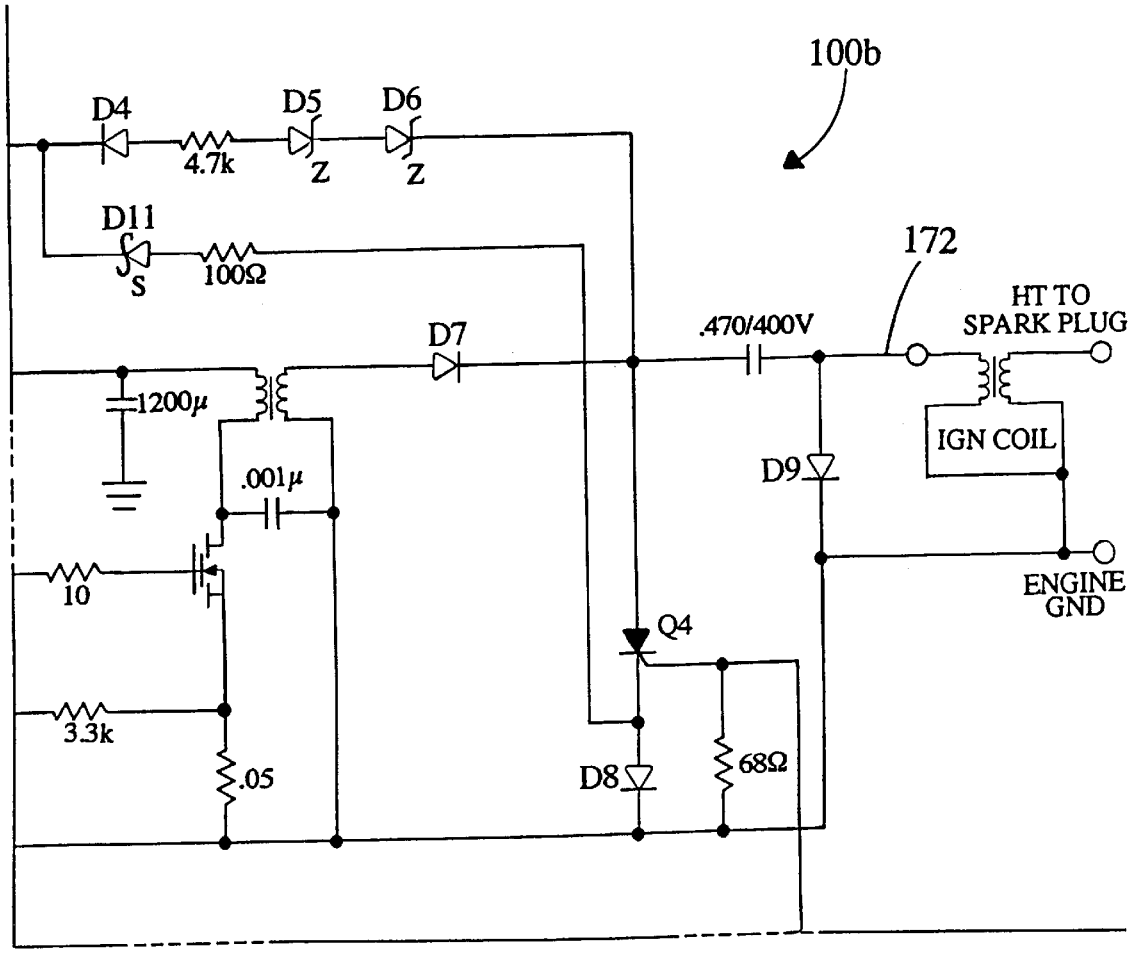
Figures 3, 3C:
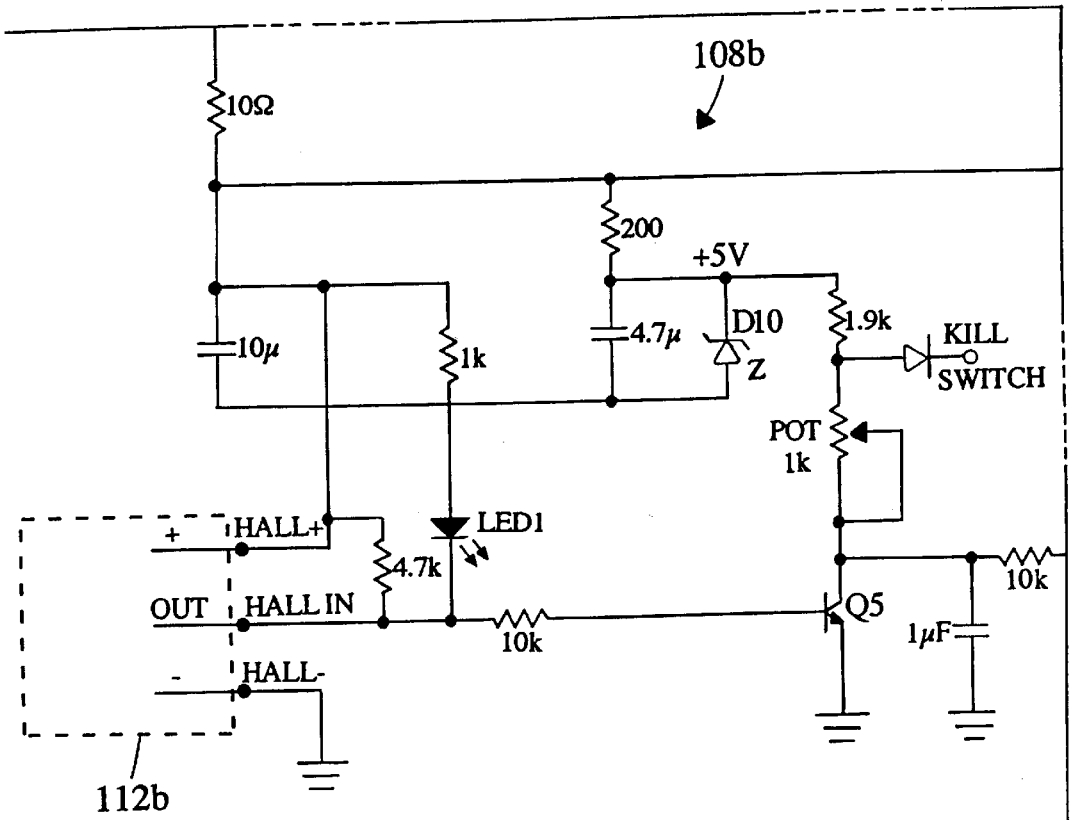
Figures 3, 3D:
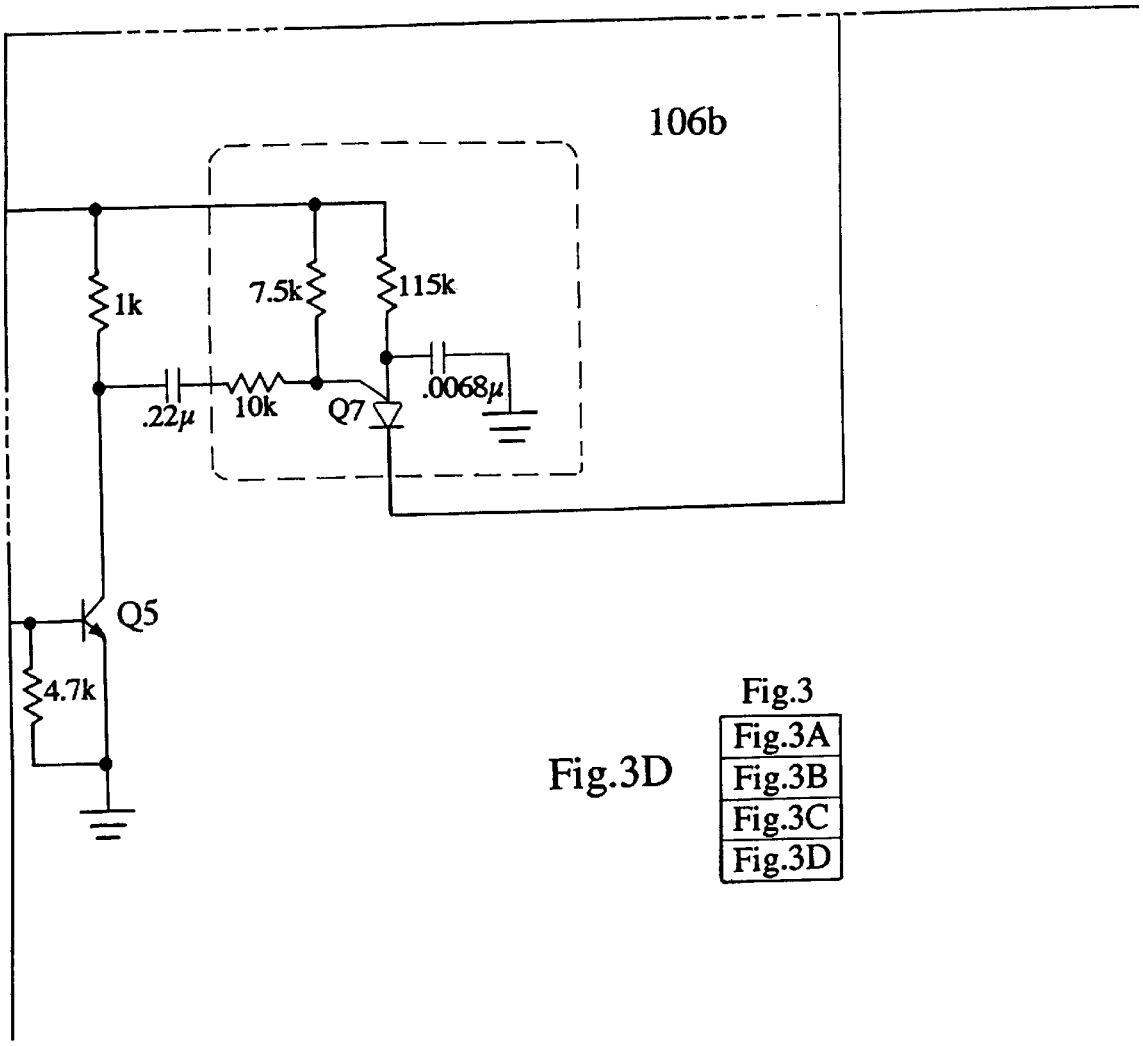

The timing circuit of FIG. 2 can be replaced with a simple adjustable retard slope using a digital Hall effect device 112*b,* such as an Allegro A3141LUA or an OPTEK OH18OU, as shown in FIG. 3. The ignition 100*b* includes a power circuit 102*b,* a multi-spark circuit 106*b,* and a timing circuit 108*b.* The circuit has only a single timing control which is mechanically set by Hall effect placement to a magnet on the rotating engine component (e.g., crankshaft). The retard slope is adjustable via a potentiometer 1000 which gives a range of 0.5° to 1° per 1000 rpm rate of timing retard. This matches the retard slope of a standard magneto, which is 0.5° per 1000 rpm. The magnet trigger is selected to give about a 30° to 35° dwell input so the multi-spark is allowed 3–4 sparks per firing at start-up. The circuit incorporates a light emitting diode LED 1 which allows verification of spark timing and the spark trigger point. The LED 1 turns on once spark output occurs. This is used to set the start timing to the value desired while the engine is not running. A strobe light may be used to verify high speed run timing. Finally, a normally open kill switch 1002, may be provided which grounds the input drive voltage to the trigger input circuit.

Both versions of the ignition, i.e., FIG. 2 and FIG. 3, use a power section 102 which is similar in operation. The power section 102 includes a current mode control integrated circuit IV1, (which may be a UCC 3805 from Unitrode), a power switch 22 and a transformer T1 to step up the 7.2 volt battery voltage to over 300 volts stored in capacitor C8, a 0.47 mf 400V device, which is discharged into the ignition coil primary under control of the silicon controlled rectifier (SCR) Q8, and the diode D9. The diode D9 is used to sense coil/SCR current flow and to momentarily disable the transistor Q2 via the transistor Q1 (FIG. 3). This keeps the converter off while SCR current is flowing from the capacitor C8 to the ignition coil 172, and enables the converter to quickly turn on when the SCR current flow ceases via D3–D4, allows the capacitor C8 to reach full charge of about 320 to 400 volts by sensing C8 voltage and turning the converter ICV1 off via Q1 at full charge.

The invention described in the above detailed described description is not intended to be limited to the specific form set forth herein but is intended to cover such alternatives, modifications and equivalents as can reasonably be included within the spirit and scope of the appended claims.

What is claimed is:

1. An ignition, comprising:

a magnetic flux responsive device configured to provide a ramp output signal based on crankshaft position;

a circuit for generating a start-mode voltage level and for generating a run-mode voltage level;

a select circuit configured to generate a reference voltage from the start-mode and run-mode voltage levels;

a timing circuit, operatively coupled to the magnetic flux responsive device, for generating start-mode and run-mode timing pulses corresponding to the start-mode and run-mode voltage levels, respectively, by comparing the reference voltage to the ramp output signal.

2. The ignition of claim 1, wherein the magnetic flux responsive device includes a Hall effect device.

3. The ignition of claim 2, wherein the Hall effect device includes a linear output Hall effect transducer (LOHET).

4. The ignition of claim 1, wherein the magnetic flux responsive device includes a flux concentrator.

5. The ignition of claim 4, wherein the flux concentrator is generally arcuate in shape.

6. The ignition of claim 4, wherein the flux concentrator is configured so that an output voltage of the magnetic flux responsive device is a substantially linear ramp with a fast falling edge.

7. The ignition of claim 1, further comprising means for setting engine timing when an engine is not running.

8. An electronic ignition, comprising:

a Hall effect device generating an output signal in response to a moving magnet;

a flux concentrator operatively coupled to the Hall effect device; and a timing circuit for generating a timing signal based on the output signal of the Hall effect device.

9. The electronic ignition of claim 8, wherein the timing circuit includes a run/start circuit for varying the timing signal as a function of engine speed.

10. The electronic ignition of claim 8, further comprising:

a spark circuit for generating a spark signal in response to the timing signal.

11. The electronic ignition of claim 10, further comprising:

a power circuit responsive to the spark signal; and an ignition coil, operatively coupled to the power circuit, for generating a high voltage output based on a power circuit output.

12. The electronic ignition of claim 8, further comprising means for setting engine timing when an engine is not running.

13. An electronic ignition, comprising:

a Hall effect device generating a periodic substantially linear ramp output voltage as a function of a varying magnetic field;

a comparator for generating a comparator output signal based on the output voltage and a reference voltage; and a run/start circuit for generating the reference voltage selected from a run mode voltage level and a start mode voltage level;

the comparator output signal indicating a run mode ignition timing while the run mode voltage level is applied as the reference voltage and a start ignition timing while the start mode voltage level is applied as the reference voltage, the start mode ignition timing being retarded relative to the run mode ignition timing.

14. The electronic ignition of claim 13, further comprising:

a spark circuit for generating a spark signal based on the comparator output;

a power circuit for generating a coil input in response to the spark signal; and a coil for generating a high voltage spark in response to the coil input.

15. The electronic ignition of claim 13, further comprising a flux concentrator operatively coupled to the Hall effect device.

16. The electronic ignition of claim 13, further comprising:

a magnet rotating about an axis so that it passes in close proximity to the Hall effect device.

17. The electronic ignition of claim 13, further comprising a ring magnet rotating in close proximity to the Hall effect device to produce the varying magnetic field.

18. The electronic ignition of claim 13, further comprising:

an RC circuit generating a comparator input signal in response to the linear ramp output voltage, the RC circuit for retarding the run mode ignition timing at high engine speeds.

19. The electronic ignition of claim 13, wherein the run/start circuit selects the reference voltage based on engine speed.

* * * * *